US005231840A

United States Patent [19]

Yagi et al.

[11] Patent Number: 5,231,840

[45] Date of Patent: Aug. 3, 1993

[54] CRYOPUMP

[75] Inventors: Nobuaki Yagi; Kazuo Miura; Hiroshi Aihara, all of Osaka, Japan

[73] Assignee: Daikin Industries, Ltd., Osaka, Japan

[21] Appl. No.: 858,895

[22] Filed: Mar. 27, 1992

[51] Int. Cl.[5] ..... B01D 8/00

[52] U.S. Cl. ..... 62/55.5; 55/269; 62/295; 417/901

[58] Field of Search ..... 62/55.5, 295; 417/901; 55/269

[56] References Cited

U.S. PATENT DOCUMENTS 4,763,483 8/1988 Olsen ..... 62/55.5

FOREIGN PATENT DOCUMENTS 0119604 9/1984 European Pat. Off. .
4006755 9/1991 Fed. Rep. of Germany .
65288 4/1985 Japan .
48974 3/1987 Japan .
157282 7/1987 Japan .
973920 11/1982 U.S.S.R. .
1622620 1/1991 U.S.S.R. .
8701768 3/1987 World Int. Prop. O. .

OTHER PUBLICATIONS

"Capability of Obtaining Extreme High Vacuum by Commercial G-M refrigerator-Cooled Cryopump", T. Kikuchi et al., vol. 3, 1990, pp. 160-162.

"Production of Extreme High Vacuum using a New--Bakeable Type Cryopump with G-M Refrigerators", Y. Matsui et al., vol. 1, 1991, pp. 37-40.

"The Ultimate Pressure of a Standard Cryopump Specified for Ultra-High Vacuum", S. Furuya et al., vol. 1, 1991, pp. 41-44.

*Primary Examiner*—Ronald C. Capossela

*Attorney, Agent, or Firm*—Sixbey, Friedman, Leedom & Ferguson

[57] ABSTRACT

To perform an even, high temperature baking treatment at about 450° C. to a cryopump for the achievement of an extremely high vacuum, the cryopump is divided into two, a pump section P and a refrigerator R; the pump section P is cut off, with a vacuum state maintained, from the refrigerator R; and cooling stages 49 and 69 of the refrigerator R are connected through detachable heat transfer means 53 and 73 to cryopanel 2 and 5 of the pump section P, whereby the pump section P and the refrigerator R being detachably connected together. A drive unit of the refrigerator R and a casing 1 of the pump section P are connected together by a bellows 36, and at least a part of the transfer means 53, which connects the cooling stage 49 and 69 of the refrigerator R to the cryopanels 2 and 5 of the pump section P, made of a flexible material.

12 Claims, 7 Drawing Sheets

CRYOPUMP

BACKGROUND OF THE INVENTION

This invention particularly pertains to a cryopump suitable for creating an extremely high vacuum. It also relates to a cryopump which is available for obtaining a high or ultra high vacuum.

PRIOR ART

A cryopump has been extensively used as a vacuum pump, which has in its casing a cryopanel that is cooled down to an extremely low temperature level by means of a refrigerator. In such a cryopump, an incoming gas molecule in the casing, admitted from a vacuum vessel, is captured and held by condensation or adsorption in order that the vacuum vessel is exhausted.

A conventional cryopump may reach a ultra high vacuum level, however, the degree of vacuum of which is as high as of about $10^{-8}$ Pa ($10^{-10}$ Torr) at the most. A technique for obtaining an extremely high vacuum (i.e., below $10^{-10}$ Pa) is now required in various research fields concerning new functional elements and materials, surface physics, and basic physics. Since the number of gas molecules existing in the extremely high vacuum space is extremely few, particle-scattering, energy absorption and other influences due to the presence of a gas molecule are almost negligible. For this beneficial aspect, the technique of obtaining an extremely high vacuum is very useful in researches of high energy physics or in experiments on synchroton orbital radiation. Besides, it is feasible to maintain a super-clean surface that is free from any surface contamination due to the presence of a gas molecule, using an extremely high vacuum. Accordingly, the extremely high vacuum technique is very useful for physical property researches and analytic experiments for surfaces and interfaces in the field of basic science. In addition, with regard to industrial applications, it is applicable to researches for the development of new materials and for the improvement in LSI integration.

However, it has been very difficult to obtain extremely high vacuum with a conventional cryopump. This is because of a baking treatment in which a vacuum vessel and a casing wall surface of a pump section are heated while performing vacuum exhaust in order to reduce the gas emission from them. To perform such a baking treatment in a most efficient way and to obtain a higher degree of vacuum in a shorter time, it is most essential to evenly apply a higher temperature heat. In conventional cryopumps, however, a cryopanel in a pump section is connected directly to a refrigerator. Accordingly, it has not been possible to excessively heat the pump section because of the temperature limitation in relation to the heat resistance (for instance, 70° C.) of a refrigerator employed.

In view of the above, an improved cryopump is shown in a report (entitled "Production of Extreme High Vacuum using a New-Bakeable Type Cryopump with G-M Refrigerators" in the publication "Shinku (vacuum)", pages 37–40, No.1, Vol.34), wherein the cryopump is so constructed that a cryopanel is separated from the refrigerator with a vacuum state maintained.

However, even such a cryopump has some problems. The cryopanel of the cryopump of this type is separated from the refrigerator with a vacuum state maintained, and further the refrigerator is housed within an adiabatic vessel which is isolated from the pump section. The refrigerator is however connected integrally to the pump section in order that the refrigerator is in a heat transferable relationship with the cryopanel. Because of this arrangement, it is inevitable that the refrigerator is influenced by heating during a baking treatment, as a result of which the refrigerator is heated above the temperature limitation to the heat resistance when a heating temperature for the pump section rises. Accordingly, it is not possible to evenly apply heat throughout the pump section in principle because of the heating restrictions applied to portions of the pump section on the refrigerator side. And heating temperature for the pump section is also limited, so that the drawbacks such as the increase of load of the refrigerator arise.

The present invention is made to overcome the above-described drawbacks. It is an object of the invention to evenly heat the pump section without exerting any thermal influences to the refrigerator during the baking treatment by improving a joint structure between the pump section and the refrigerator. Accordingly, it is possible to perform a baking treatment at about 450° C. and to achieve easily an extremely high vacuum by employing a cryopump in accordance with the invention.

It is another object of the invention to provide a cryopump not only for generating an extremely high vacuum, but also for creating a ultra high or high vacuum.

SUMMARY OF THE INVENTION

To achieve the above objects, in the present invention, the pump section is so constructed that it is completely separable from the refrigerator. In other words, the cryopump of the invention has the pump section with a cryopanel which is housed in a casing that communicates with a vacuum vessel, and the refrigerator with a cooling stage for generating cold of an extremely low temperature level so as to cool the cryopanel of the pump section down to such an extremely low temperature level.

With regard to the pump section and the refrigerator, the inside of the casing of the pump section is cut off from the refrigerator with a vacuum state maintained, and the cooling stage of the refrigerator and the cryopanel of the pump section are connected together through detachable heat transfer means so that they are connected with each other in a separable manner.

A sealing structure of the pump section, and a heat transfer structure for transferring cold generated by the refrigerator to the cryopanel of the pump section can be specified. That is, the cryopanel of the pump section is connected to the casing by a tubular sealing member of a low heat conductivity material, the heat transfer means being arranged in the sealing member with a gap between them.

It is also possible to adopt a vibration isolating structure to shut off vibrations which are transferred to the pump section from the refrigerator, that is, a drive unit of the refrigerator and the casing of the pump section are connected together by a bellows. And at least a part of the heat transfer means, which connects the cooling stage of the refrigerator to the cryopanel of the pump section, is made up of a flexible member.

The heat transfer means includes the flexible member having stretchability to such an extent that the detachment of the heat transfer means can be carried out when separating the pump section from the refrigerator.

The pump section includes at least first and second cryopanels, the second cryopanel being disposed in the first cryopanel. The refrigerator, on the other hand, has at least two cooling stages for individually cooling the first and second cryopanels so that the second cryopanel is cooled to a lower temperature than the first cryopanel.

In the above constitution, in order to have one of the heat transfer means served also as a radiation shield material, the one heat transfer means for establishing heat transfer between the first cryopanel of the pump section and the one cooling stage of the refrigerator is disposed so as to cover and radially shield the other heat transfer means for establishing heat transfer between the second cryopanel of the pump and the other cooling stage of the refrigerator in the joint section between the pump section and the refrigerator.

In addition to the above constitution in which the pump section has the first and second cryopanels while the refrigerator has the two cooling stages, the pump section, including the first and second cryopanels, is made of an inorganic material such as metal.

For the purpose of securing the increase of an adsorption surface area for gas molecules, particularly for hydrogen molecules in the pump section, a mesh member of a high heat conductivity material is integrally joined to the inner surface of the second cryopanel. Alternatively, the inner surface of the second cryopanel can be processed into a mesh form.

It is preferable that the heat transfer means comprises a heat transfer member on the pump section side and a heat transfer member on the refrigerator side, both heat transfer members being detachably tied together by a bolt. Alternatively, the heat transfer means comprises the heat transfer members on the pump and refrigerator sides in which both heat transfer members are removably connected with each other in a heat transferable manner by a concave section and a convex section which is fitted into the concave section.

PREFERRED EMBODIMENT OF THE INVENTION

The embodiments of the invention will be described with reference to the accompanying drawings.

FIRST EMBODIMENT

Figure 1:
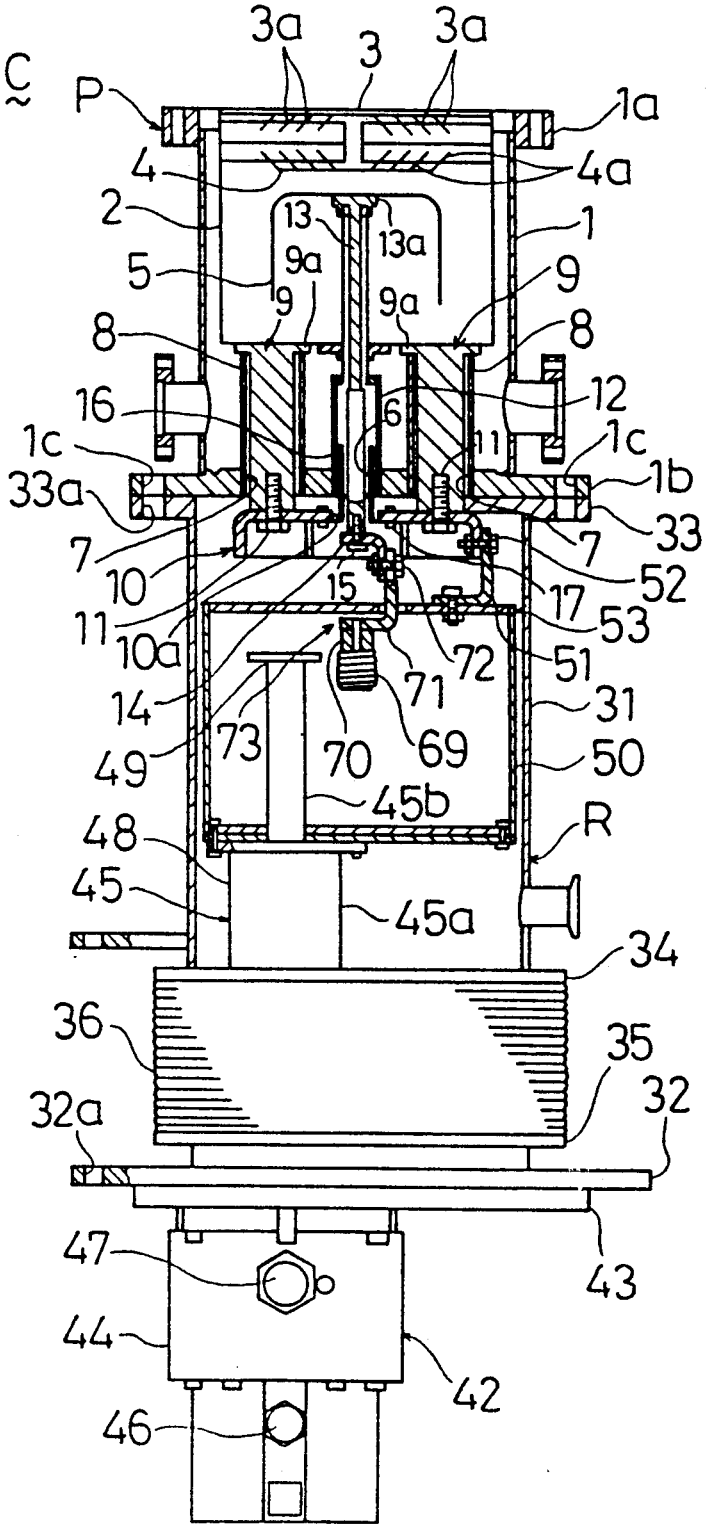
FIG. 1 is a sectional view of a cryopump of a first embodiment of the invention.

FIG. 1 shows a cryopump C of a first embodiment of the invention. The cryopump C comprises a pump section P and a refrigerator R. The pump section P has a tubular casing 1 with a bottom, which is made of a stainless steel as a low heat conductivity material. The casing 1 opens upward. Formed on the periphery of the opening of the casing 1 is a mounting flange 1*a*. By vacuum sealing and connecting the mounting flange 1*a* to a vacuum vessel (not shown), the pump section P is made to communicate with the vacuum vessel.

A first tubular cryopanel 2 with a bottom, which functions as a radiation shield and opens upward, and a second tubular cryopanel 5 with a bottom, which is disposed within the first cryopanel 2 and opens downward, are concentrically housed in the casing 1. Mounted on the upper end of the opening of the first cryopanel 2 are a pair of baffles 3 and 4 arranged vertically and having louvers 3*a* and 4*a* for scattering incoming gas molecules in the casing 1 admitted from the vacuum vessel. The cryopanels 2 and 5, and the baffles 3 and 4 are made of a copper as a high heat conductivity material. Like an ordinary cryopump, activated charcoal is bonded to the inner surface (inner bottom surface to inner peripheral surface) of the second cryopanel 5, although not shown in the drawing.

The bottom wall of the casing 1 is thicker than the other portions thereof. Formed on the periphery of the bottom wall is a mounting flange 1*b* having a bolt hole 1*c*. Opened in the center of the bottom wall is a center hole 6. A plurality of holes 7, surrounding the center hole 6, are formed in the periphery of the bottom wall. A tubular sealing member 8, made of a thin stainless steel, is fitted into each of the holes 7. The lower end of the tubular sealing member 8 is sealed and welded to the periphery of the hole 7. On the other hand, the upper end of the tubular sealing member 8 is sealed and brazed to the lower edge of an upper end flange part 9*a* of a copper heat transfer rod 9 which passes through the tubular sealing member 8 with a gap between them. The upper end face of the flange part 9*a* of the heat transfer rod 9 is tightly secured by a bolt to the back face of the periphery of the bottom wall of the first cryopanel 2 in a good thermal contact manner. The lower end of the heat transfer rod 9 extends down the bottom wall of the casing 1 of the pump section P, and is tightly secured to a dish-like copper disk 10 whose peripheral end is bent and extends downward by a given length so that the disk 10 opens downward, by a stainless steel bolt 11 at its periphery in a good thermal contact manner. The disk 10 is in a heat transferable relationship with the first cryopanel 2 through the heat transfer rod 9.

Fitted into the center hole 6 of the bottom wall of the casing 1 is a tubular sealing member 12 made of a thin stainless steel. The lower end of the tubular sealing member 12 is sealed and welded to the periphery of the center hole 6. The tubular sealing member 12 is reduced in diameter below the bottom wall of the first cryopanel 2, forming a small diameter part. The small diameter part passes through the bottom wall of the first cryopanel 2, extending to the inside of the first cryopanel 2. The upper end of the tubular sealing member 12 is sealed and brazed to the lower edge of an upper end flange section 13*a* of a copper heat transfer rod 13 that passes through the tubular sealing material 12 with a gap between them. The upper end face of the flange 13*a* of the heat transfer rod 13 is tightly secured to the center of the inner surface of the bottom wall of the second cryopanel 5 in a good heat contact manner by a bolt. The lower end of the heat transfer rod 13 passes through an opening 10*a* defined in the center of the disk 10, extending to the inside of the disk 10, and is tightly secured by a copper bolt 15 to an L-shaped heat transfer member 14 made of a copper. The heat transfer member 14 is in a heat transferable relationship with the second cryopanel through the bolt 15 and the heat transfer rod 13. In addition, the lower end of a copper tubular member 16 is tightly secured concentrically to the periphery of the opening 10*a* of the disk 10 by a bolt 17. The tubular member 16 extends through a gap defined between the tubular sealing member 12 and the heat transfer rod 13 as far as it reaches the middle of the tubular sealing member 12 or thereabouts.

The above refrigerator comprises a J-T (Joule-Thomson) type helium refrigerator. The helium refrigerator R has a tubular housing 31 with a bottom that opens upward. The bottom wall of the housing 31 is thicker than the other portions thereof, and is formed on a mount 32 having a bolt hole 32*a* at its periphery. The refrigerator R is firmly supported by the mount 32. At the periphery of the opening of the upper end of the housing 31, a mounting flange 33 having a bolt hole 33*a* is formed so that it corresponds to the mounting flange 1*b* of the casing 1 of the pump section P. The mounting flange 33 is tightly secured to the mounting flange 1*b* of the pump section P by a bolt (not shown) that passes through the bolt holes 33*a* and 1*c* so that the pump section P is vacuum sealed and connected to the refrigerator R.

The lower section of the side wall of the housing 31 is partly cut out at determined spaced intervals in a vertical direction. Flanges 34 and 35 are formed at the upper and lower edges of the cut-out portions, respectively. These flanges 34 and 35, vertically arranged, are vacuum sealed by a tubular bellows 36 having the same center as the housing 31, and are connected together. Because of the bellows 36, vibrations due to the rotation of a rotary valve and valve motor and the reciprocating movement of a displacer housed in a cylinder 45 (these elements will be described later) are not transmitted from the housing 31 to the casing 1 of the pump section P that is connected to the upper section of the housing 31.

Figure 2:
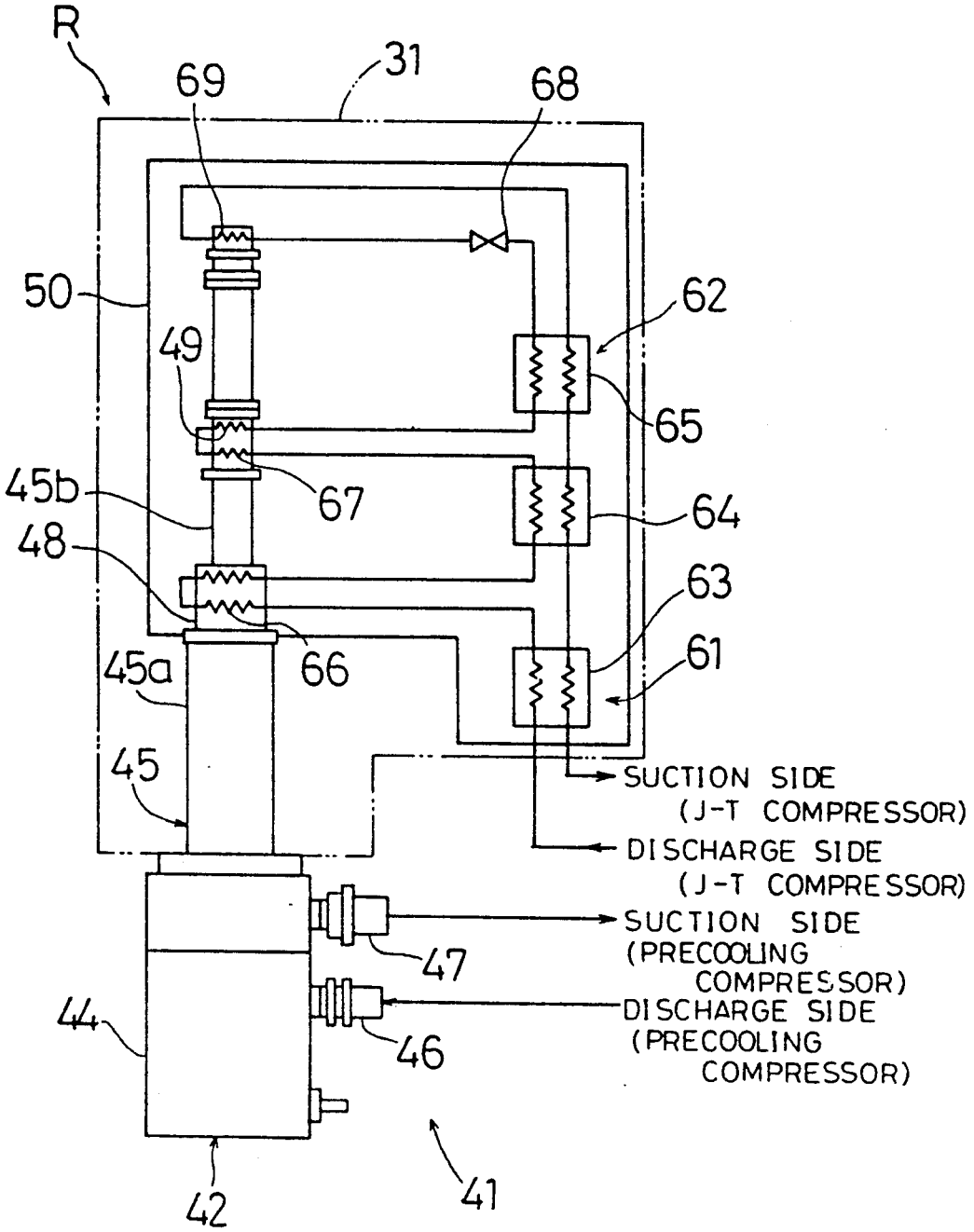
FIG. 2 is a refrigerant circuit showing the main constitution of a refrigerator.

As shown FIG. 2, the refrigerator R comprises a precooling refrigeration circuit 41 and a J-T circuit 61. The precooling refrigeration circuit 41 is a G-M (Gifford-McMahon) cycle refrigerator and is used for the compression and expansion of helium gas in order to precool it in the J-T circuit. The precooling refrigeration circuit 41 is made up by connecting a precooling compressor (not shown) and an expansion device 42 mounted on the housing 31 together in a closed circuit manner. The expansion device 42 is so mounted on an offset region of the bottom wall of the housing 31 that it passes through the bottom wall. The expansion device 42 has a sealed, closed tubular case 44 having at its upper end a flange 43 (see FIG. 1) which is superimposed on the lower surface of the bottom wall of the housing 31, and a two-stage structure cylinder 45 which is continuously mounted on the upper portion of the case 44. Opened in the case 44 are a high pressure gas inlet 46 which is connected to the discharge side of the precooling compressor and a low pressure gas outlet 47 which is connected to the suction side of the precooling compressor. The cylinder 45 passes through the mount 32 of the bottom wall of the housing 31, extending to the inside of the housing 31. The upper end of a large diameter portion 45*a* of the cylinder 45 serves as a first heat station 48, the temperature level of which is maintained at 55 to 60 K. The upper end of a small diameter portion 45*b* of the cylinder 45 serves as a second heat station 49 (cooling stage), the temperature level of which is maintained below that of the first heat station (i.e., 15 to 20 K.). The displacer (not shown), which compartments and forms an expansion chamber in the cylinder 45 at a corresponding location to each of the heat stations 48 and 49, is so fitted into the cylinder 45 that it can vertically move. Housed in the case 44 are the rotary valve and the valve motor that drives the rotary valve. The rotary valve switches, that is, it opens or shuts for every rotation for supplying to the expansion chamber in the cylinder 45 the incoming helium gas through the high pressure gas inlet 46, or for exhausting the helium gas expanded in the expansion chamber through the low pressure gas outlet 47. By opening the rotary valve, the high pressure helium gas is expanded (Simon expansion) in the expansion chamber in the cylinder 45; cold of an extreme low temperature level is generated because of a drop in temperature attended by the expansion; and the cold thus generated is stored in the first and second heat stations 48 and 49 of the cylinder 45. That is, in the precooling refrigeration circuit 41, the high pressure helium gas discharged from the compressor is fed to the expansion device 42, then the temperatures of the heat stations 48 and 49 are dropped due to adiabatic expansion at the expansion device 42 so that precoolers 66 and 67 (described hereinafter) in the J-T circuit 61 are precooled, and at the same time the low pressure helium gas expanded returns to the compressor for recompression.

As shown in FIG. 1, a roughly closed tubular shield 50 of a copper is disposed in the housing 31 so that it has the same center as the housing 31, and is supported by the first heat station 48 of the cylinder 45 in a heat transferable manner. The lower end of a mesh wire 51 of a copper having flexibility is secured to the upper wall of the shield 50, in a heat transferable manner. The upper end of the mesh wire 51 is connected to the side edge of the disk 10 on the pump section P side by a tie bolt 52 in a heat transferable manner. A first heat transfer means 53, which enables the first heat station 48 of the refrigerator R to be connected to the first cryopanel 2 of the pump section P in a heat transferable manner, comprises the shield 50, the mesh wire 51, the disk 10 and the heat transfer rod 9. The heat transfer means 53 can be detached between the disk 10 and the mesh wire 51 by, for example, removing the tie bolt 52.

On the other hand, the J-T circuit 61 is a refrigeration circuit, wherein helium gas is compressed for generation of cold of an extreme low temperature, i.e., approximately 4 K. and is expanded under Joule-Thomson expansion. The J-T circuit 61 has a J-T compressor (not shown) that compresses helium gas, and an expansion unit 62 by which the helium gas thus compressed is expanded under Joule-Thomson expansion. The expansion unit 62 has first, second and third J-T heat exchangers 63, 64 and 65 (not shown in FIG. 1) in the housing 31. These J-T heat exchangers 63, 64 and 65 serve to perform heat exchange between a helium gas passing through their respective primary sides and another helium gas passing through their respective secondary sides. The primary side of the first J-T heat exchanger 63 is connected to the discharge side of the J-T compressor. The primary sides of the first and second J-T heat exchangers 63 and 64 are connected with each other through a first precooler 66 disposed around the outer circumference of the first heat station 48 of the expansion device 42. Similarly, the primary sides of the second and third J-T heat exchangers 64 and 65 are connected together through a second precooler 67 disposed around the outer circumference of the second heat station 49 of the expansion device 42. The primary side of the third J-T heat exchanger 65 is connected to a cooler 69 through a J-T valve 68 for Joule-Thomson expansion of a high pressure helium gas. The degree of opening of the J-T valve 68 is controlled from the outside of the housing 31, using a control rod (not shown). The cooler 69 is connected through the respective secondary sides of the third and second J-T heat exchangers 65 and 64 to the secondary side of the first J-T heat exchanger 63. The secondary side of the first J-T heat exchanger 63 is connected to the suction side of the J-T compressor. Accordingly, in the J-T circuit 61, helium gas is compressed to a high pressure by the J-T compressor; then the helium gas thus compressed is fed to the housing side; in the first, second and third J-T heat exchangers 63, 64 and 65, the helium gas exchanges heat with the other low temperature, low pressure helium gas that is on the way back to the compressor, and it is cooled by the first and second precoolers 66 and 67 at the first and second heat stations 48 and 49; thereafter the helium gas is expanded by the J-T valve 68 (Joule-Thomson expansion) and changes its form to a gas-and-liquid mixture helium of 1 atmospheric pressure and about 4 K. By latent heat of vaporization of the helium, the cooler 69 is cooled to an extreme-low temperature level i.e., approximately 4 K. Then, the helium gas whose pressure level has dropped due to the expansion is drawn into the J-T compressor through the individual secondary sides of the first, second and third J-T heat exchangers 63, 64 and 65 for recompression.

Again, referring to FIG. 1, the cooler 69 is made up of piping which takes the form of a coil and is wound around the outer circumference of a tubular cold receiving member 70 of a copper. The cooler 69 is aligned with the center line of the housing 31. Because of this structure, the cooler 69 is brought into contact with the cold receiving member 70 in a heat transferable manner. In addition, the upper end of the cold receiving member 70 is secured to the lower end of a copper mesh wire 71 having flexibility in a heat transferable manner. The mesh wire 71 passes through the shield 50, and its upper end is connected in a heat transferable manner to the lower end of the heat transfer member 14 of the pump section P side by means of a tie bolt 72. And a second heat transfer means 73, which connects the cooler 69 (i.e., a cooling stage of the refrigerator R) to the second cryopanel 5 of the pump section P in a heat transferable manner, comprises the cold receiving member 70, the mesh wire 71, the heat transfer member 14 and the heat transfer rod 13. This heat transfer means 73 can be detached between the heat transfer member 14 and the mesh wire 71 by removing the tie bolt 72.

According to this embodiment, with its vacuum state maintained, the inside of the casing 1 of the pump section P is cut off from the refrigerator R. The first heat station 48 of the refrigerator R and the cooler 69 are connected through the corresponding detachable heat transfer means 53 and 73 to the first and second cryopanels 2 and 5 of the pump section P, respectively. Because of this structure, the pump section P and the refrigerator R are connected together in a physically separable manner.

The disk 10, which constitutes a part of the first heat transfer means 53 for establishing heat transfer between the first cryopanel 2 of the pump section P and the first heat station 48 of the refrigerator R, is disposed so that it covers the heat transfer member 14 and the bolts 15 and 72 positioned in the center region of the disk 10 from the upper direction, i.e., from the pump section P side. Because of this structure, the first heat transfer means 53 is disposed, at the joint section between the pump section P and the refrigerator R, to partly cover and radially shield the heat transfer means 73 for establishing heat transfer between the second cryopanel 5 of the pump section P and the cooler 69 of the refrigerator R.

Next, the operation of the embodiment will be described. With the running of the refrigerator R, the cryopanels 2 and 5 in the pump section P are cooled so that the pump section P becomes ready for operation. In other words, when the refrigerator R turns into a steady operating state, a high pressure helium gas, introduced from the precooling compressor, is expanded in the precooling refrigeration circuit 41 by means of the expansion device 42. Because of a drop in temperature attended by the expansion, the first and second heat stations 48 and 49 of the cylinder 45 are cooled down to 55 to 60 K. and 15 to 20 K., respectively. As the first heat station 48 is cooled, the temperature of the first cryopanel 2, connected in a heat transferable manner to the first heat station 48 through the mesh wire 51, the disk 10 and the heat transfer rod 9, cools to the same temperature level as the first heat station 48, as a result of which the first cryopanel 2 radially shields the second cryopanel 5 from its circumference.

Meanwhile, in the J-T circuit 61, the high pressure helium gas discharged from the compressor is admitted to the primary side of the first J-T heat exchanger 63, wherein the helium gas exchanges heat with the other low pressure helium gas of the secondary side which is on the way back to the compressor side and is cooled from an ordinary temperature of 300 K. down to about 70 K. Thereafter, the helium gas enters the first precooler 66 around the outer circumference of the first heat station 48 of the expansion device 42 which has been cooled to 55 to 60 K. so that it is therefore cooled to approximately 55 K. Then, the gas thus cooled enters the primary side of the second J-T heat exchanger 64 and is likewise cooled to approximately 20 K. by heat exchange with the other low pressure helium gas of the secondary side thereof Next, the gas enters the second precooler 67 disposed around the outer circumference of the second heat station 49 of the expansion device 42 which has been cooled to 15 to 20 K. so that it is cooled down to approximately 15 K. Further, the gas is admitted to the primary side of the third J-T heat exchanger 65; it is cooled to approximately 5 K. by heat exchange with the other helium gas of the secondary side; and then it reaches the J-T valve 68. At the J-T valve 68, the high pressure helium gas is compressed and then expanded (Joule-Thomson expansion) so that it takes the form of a gas-and-liquid mixture helium. Then, it is supplied to the cooler 69. In the cooler 69, the cold receiving member 70 is cooled by latent heat of vaporization in the liquid portion of the helium in the form of a gas-and-liquid mixture. As the cold receiving member 70 cools down, the temperature of the second cryopanel 5, contacted in a heat transferable manner with the cold receiving member 70 through the mesh wire 71, the heat transfer member 14 and the heat transfer rod 13, cools to an extreme low temperature (i.e., the temperature level of 4 K).

In this way, the temperatures of the first and second cryopanels 2 and 5 cool to an individual given extreme low temperature level so that incoming gas molecules, which are introduced to the inside of the casing 1 from the vacuum vessel connected to the pump section P, are brought in contact with the second cryopanel 5 so that they condenses or are held thereon by adsorption. By this way, it is possible to obtain a vacuum state in the vacuum vessel by exhausting it.

According to the embodiment, the casing 1 of the pump section P is cut off from the housing 31 of the refrigerator R, with its vacuum state maintained. In addition, the first heat station 48 and the cooler 69 in the refrigerator R are connected to the first and second cryopanels 2 and 5 of the pump section P, respectively through the corresponding detachable heat transfer means 53 and 73. Because of this, when carrying out a baking treatment to the pump section P and the vacuum vessel prior to exhausting the pump section P by the running of the refrigerator R, it is feasible to separate the pump section P from the refrigerator R. More specifically, with the pump section P still connected to the vacuum vessel, the above separation can be made by releasing a bolt to remove the flange 1*b* of the bottom wall of the casing 1 from the flange 33 of the upper end of the inside of the housing 31 in the refrigerator R and by releasing the bolts 52 and 72 to separate the disk 10 and the heat transfer member 14 from the mesh wires 51 and 71. The disk 10 uncovered and other elements of the pump section P removed are covered by a vacuum cover, and the inside thereof is sucked vacuum by a vacuum pump. With this state, heat is applied to from the circumference of the casing 1. At this time, the pump section P is separated from the refrigerator R, so that even if heating temperature is raised, there arise no problems that the heat transfers to the refrigerator R, causing it to be heated above its heat resistance. This enables a baking treatment at a higher temperature, that is, it is possible to heat the casing 1 of the pump section P at 450° C. or thereabouts. Conventionally, it is required to hold down the temperature of the refrigerator R side, which results in the unevenness of heat distribution. However, according to the embodiment, the casing 1 can be heated evenly without the unevenness of heat distribution. An extremely high vacuum below $10^{-10}$ Pa can be easily accomplished, accordingly.

When carrying out the exhaust of the pump section P by the running of the refrigerator R after the baking treatment, the pump section P and the refrigerator R can be connected together in the reversal order of removal.

In the embodiment, the first and second cryopanels 2 and 5 of the pump section P are connected to the casing 1 by means of the tubular sealing members 8 and 12 of a thin stainless steel, respectively. The heat transfer rods 9 and 13 are disposed in the tubular sealing members 8 and 12 respectively with a gap between them. As a result, the space in the casing 1 of the pump section P is vacuum sealed against the atmosphere by means of the tubular sealing members 8 and 12. And by utilizing the properties of a thin stainless steel (i.e., low heat conductivity), the difference in temperature between the lower ends (i.e., in the vicinity of the casing 1) and the upper ends (i.e., in the vicinity of the cryopanels 2 and 5) of the tubular sealing members 8 and 12 can be hold great. Accordingly, it is possible to cool the cryopanels 2 and 5 while insulating efficiently them against the atmosphere.

Further, the housing 31 of the refrigerator R is vertically separated into two sections, the two sections being connected by means of the bellows 36. Accordingly, even if vibrations are generated due to the rotation of the valve motor or rotary valve in the refrigerator R as well as the reciprocating movement of the displacer in the cylinder 45, such vibrations are to be absorbed by the bellows 36 while traveling from the bottom to the top of the housing 31. Besides, the shield 50 of the refrigerator R is connected to the disk 10 of the pump section P by the mesh wire 51 having vibration absorbability and flexibility, and the cooler 69 of the refrigerator R is likewise connected to the heat transfer member 14 by the mesh wire 71 having vibration absorbability, so that possible vibrations from the refrigerator R side are absorbed by the mesh wires 51 and 71 while such vibrations are traveling from the shield 50 and the cooler 69 toward the disk 10 and the heat transfer member 14, respectively. As a result, vibration transmission to the pump section P is completely avoided, ensuring at the same time efficiency of heat transfer with respect to the cryopanels 2 and 5 of the pump section P. Accordingly, surface analyses and physical property measuring experiments can be carried out effectively.

The disk 10, which constitutes a part of the first heat transfer means 53 for establishing heat transfer between the first cryopanel 2 of the pump section P and the first heat station 48 of the refrigerator R, covers the heat transfer member 14, the bolts 15 and 72 and other elements from the pump section P side. The disk 10 also covers partly and shields radially the second heat transfer means 73 at the joint section of the pump section P and the refrigerator R. Because of this, it is possible to have the disk 10, having essentially a heat transfer function, served also as a radiation shield material for blocking off heat. Accordingly, there is no need to separately provide a radiation shield material, which leads to the decrease of the number of parts and to low costs.

Figure 3:
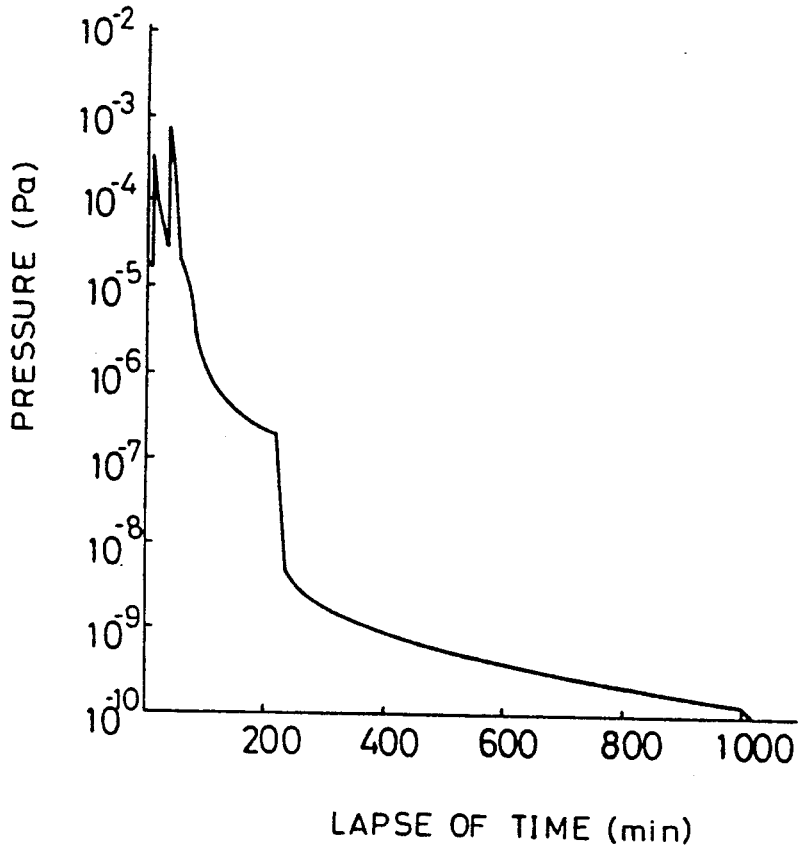
FIG. 3 is a characteristic diagram showing the variation of a degree of vacuum when the cryopump is under operation.
Figure 4:
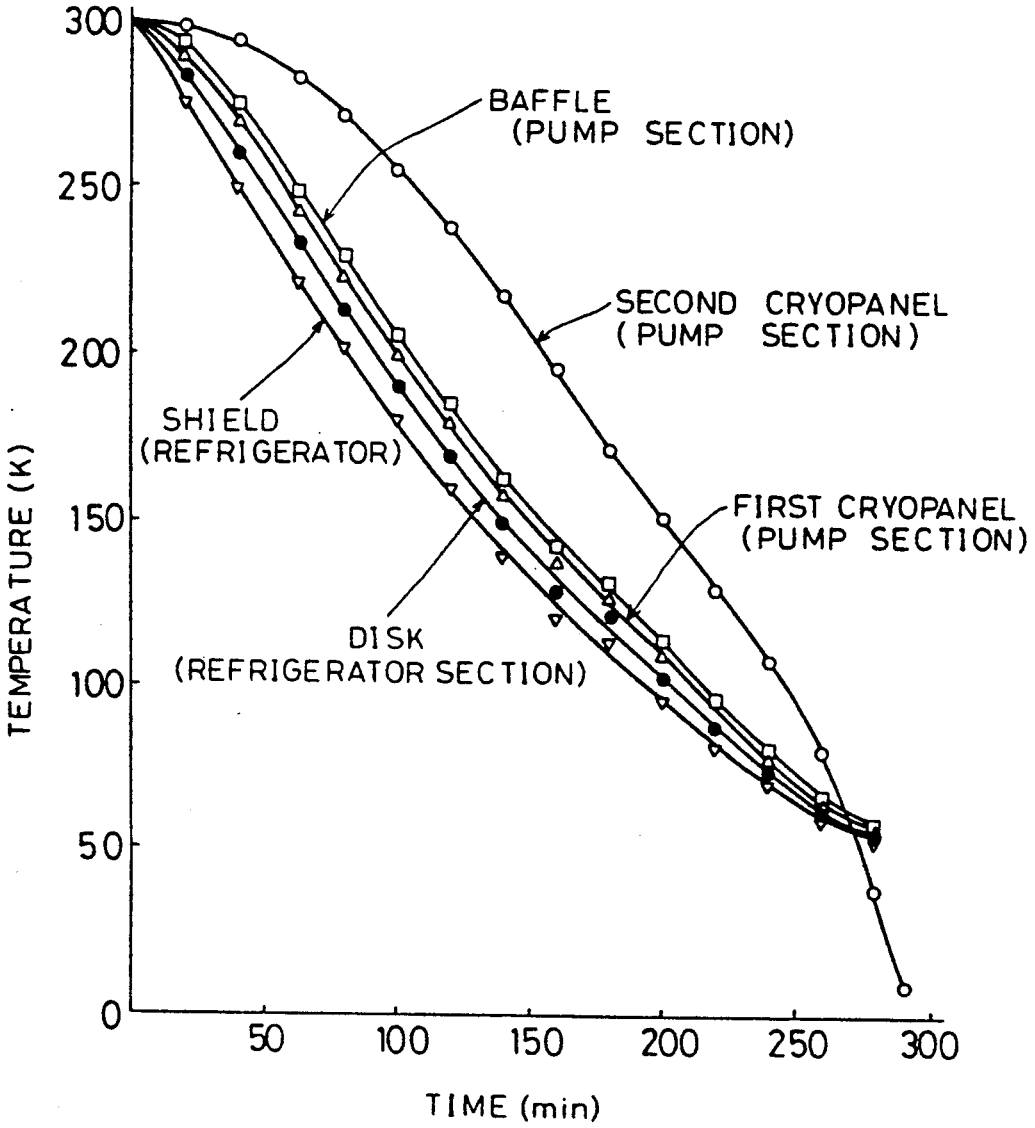
FIG. 4 is a characteristic diagram showing the variation of temperature of each element of the cryopump when the cryopump is under operation.

Experiments were performed by the inventors with respect to the cryopump C of the above described embodiment, wherein, during cool down running of the refrigerator R with the pump section P assembled thereto, the temperatures of the first and second cryopanels 2 and 5, the lower baffle 4, the disk 10 and the shield 50 of the refrigerator R were measured at fixed intervals. The results thereof are shown in FIG. 4. The temperature of the second cryopanel 5 of the pump section P cooled down to 6 K in the cool down running of 290 min. In addition, in the experiments, an experimental vacuum vessel was attached to the cryopump C, a baking treatment was carried out with the refrigerator R separated from the pump section P, and then cool down running was carried out after connecting the refrigerator R to the pump section P, during which the degree of vacuum in the vacuum vessel changed as shown in FIG. 3. Finally, an extremely high vacuum below $1\times10^{-10}$ Pa was obtained.

Figure 5:
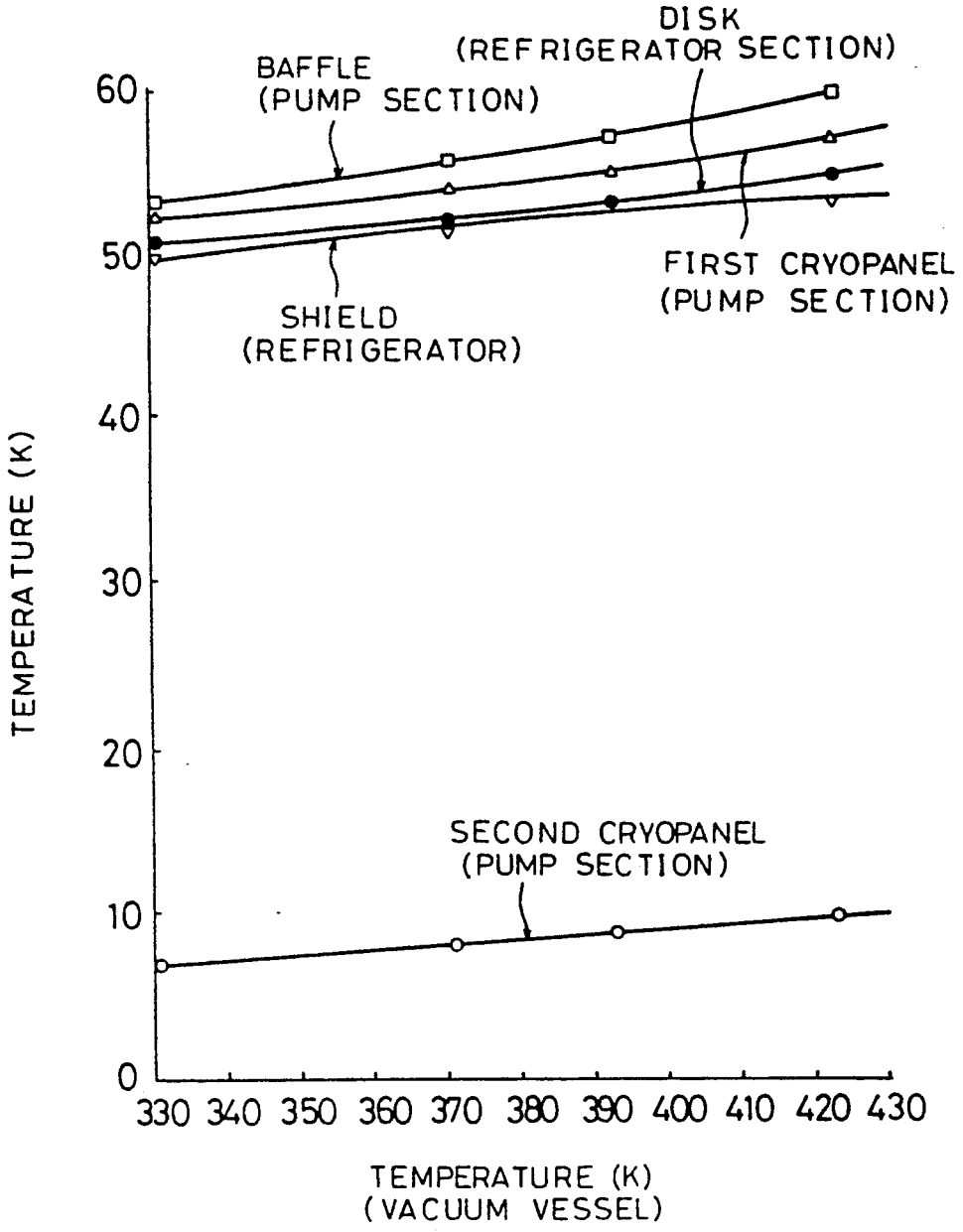
FIG. 5 is a characteristic diagram showing the variation of temperature of each element of the cryopump when heat load is applied to the pump section of the cryopump.

In addition to the above, with a stable condition after cool down running of the cryopump C, the pump section P was given heat load from the vacuum vessel. Changes in temperature of each of the above elements in relation to the temperature of the vacuum vessel were measured, the results of which are shown in FIG. 5.

The results of these experiments show that an extremely high vacuum can be obtained easily in a short time by using the cryopump of the invention, and that such an extremely high vacuum can be maintained stably against heat load.

SECOND EMBODIMENT

Figure 6:
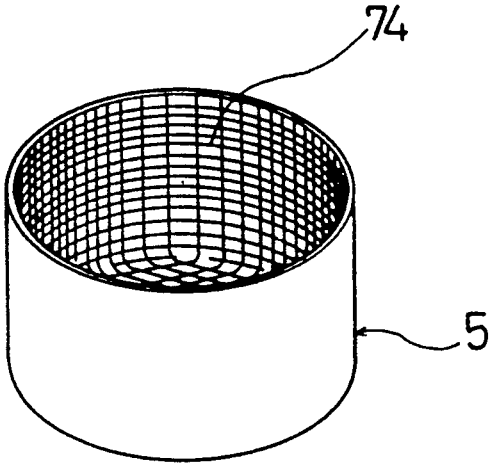
FIG. 6 is a perspective view of a second cryopanel of a second embodiment of the invention viewing from its rear side.

FIG. 6 shows a second embodiment of the invention. In the pump section P in the cryopump C of the first embodiment, activated carbon is bonded to the inner surface (inner bottom surface to inner circumference surface) of the second cryopanel 5 that is cooled to a lower temperature than the first cryopanel 2. However, such activated charcoal is not utilized at all in the second embodiment. Instead, in the second embodiment, the whole cryopanel 5 is made of a metal panel only, that is, the whole pump section P is made of a metal.

As shown in FIG. 6, the mesh member 74, which is formed by weaving thin wires of a copper that is a high heat conductivity material, is integrally joined to the inner surface (inner bottom surface to inner circumference surface) of the second cryopanel 5 by brazing. Apart from this, the second embodiment is the same as the first embodiment.

The main object of the second embodiment will be described. This embodiment is intended for more advantageously obtaining the effect of the present invention in relation to extremely high vacuum. As described above, the whole pump section P is made of a metal, which enables the pump section P itself to be constructionally stable at the time of a baking treatment at a high temperature. The amount of gas release can be also remarkably reduced. And the release of any possible contamination gas liable to adsorb on a surface is prevented, so that the vacuum system is not contaminated. As a result, an extremely clean vacuum environment can be obtained.

In addition, since activated charcoal that has been conventionally used is not employed, the emission of a ultrafine particle included in the activated charcoal or possible ultrafine particles or fragments due to the damage of the activated carbon is avoided. In this way, a clean environment free from any contamination source of ultrafine particles can also be accomplished.

Further, the embodiment will be described in detail. The prior art and the first embodiment of the invention show such a structure that activated carbon is stuck to the inner surface of the second cryopanel 5 by means of organic adhesives. In such a structure, practically, a baking treatment at a high temperature is not possible because of the temperature limitation with respect to the heat resistance of the adhesives used. In addition to this disadvantage, the great amount of gas is given off at the time of heating, and the gas released contains a contamination gas such as organic vapor which contaminates surfaces. This leads to such a problem that vacuum system surfaces and measurement instruments are subject to contamination. And there is an inevitable problem that the activated charcoal itself is a generating source of ultrafine particles.

The reasons for utilizing a activated charcoal as a low temperature adsorbing material in cryopumps are as follows. In the event that gases are exhausted by means of a cryopump, it is necessary to carry out exhaust operations by means of adsorption because it is not possible to exhaust gases such as helium, hydrogen and neon by means of condensation. To continuously exhaust these gases over a long period, a certain material with a large adsorbing area is required. For this reason, activated charcoal which has a considerably large adsorbing area is a suitable material.

Against this, in an extremely high vacuum state, that is, under a sufficiently low pressure condition, the amount of gases to be adsorbed is limited to a sufficiently low level so that a large adsorbing area is not essentially required. This condition practically and sufficiently assures a long time continuous operation. Accordingly, there is no necessities for using activated charcoal.

By making the whole pump section P from a metal according to the embodiment, any problems caused by using activated charcoal are solved, and a clean, efficient cryopump available for practical use is obtained.

Although, as described above, it is an object of the embodiment to provide a cryopump without including in a pump section P any activated charcoal, adhesives or the like that emits organic materials or ultrafine particles harmful for a clean vacuum environment, it will provide also the following related effects.

Because of the structure of the embodiment in which the mesh member 74 made of a high heat conductivity material is integrally connected to the inner surface of the second cryopanel 5 by brazing, it is possible to maintain the low temperature adsorbing surface of the inner surface of the second cryopanel about ten times greater than the one without the mesh member 74 connected thereto. Accordingly, the adsorbing and holding of gas molecules including helium, hydrogen and neon can be effectively done.

Instead of connecting the mesh member 74 to the second cryopanel 5 by brazing, it is possible to process the inner surface of the second cryopanel 5 itself by cutting, chemical etching, or other means to form an uneven surface thereon. Alternatively, the second cryopanel 5 may be fabricated by using an inorganic material to form a variety of surface forms, in other words surface morphology (for example, to form fine holes at the level of atom) on the inner surface by a sputter method, CVD method, vacuum evaporation or other vapor phase growth methods to obtain a larger adsorbing surface as an adsorbing medium. The same effects as the second embodiment are obtained in this case.

THIRD EMBODIMENT

Figure 7:
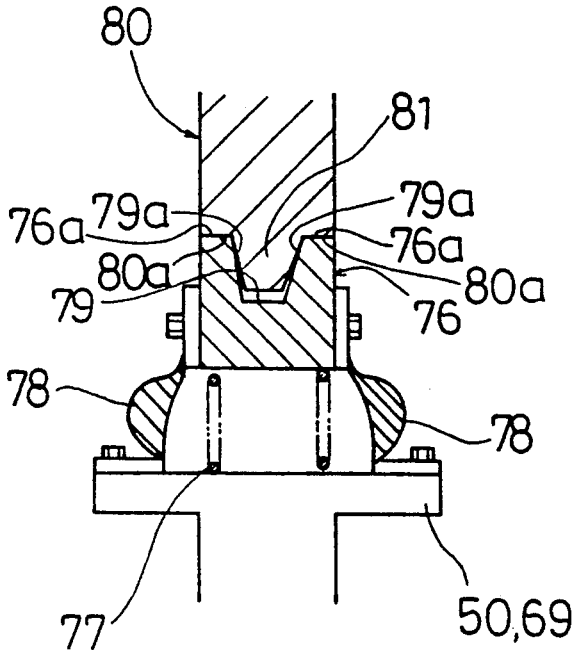
FIG. 7 is an enlarged sectional view of a heat transfer construction between the pump section and the refrigerator of a cryopump of a third embodiment of the invention.
Figure 8:
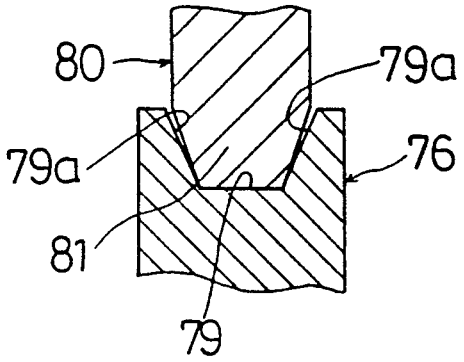
FIG. 8 is a sectional view of another heat transfer construction of the third embodiment.

FIGS. 7 and 8 show a third embodiment. It is an object of the invention to obtain a structure in which the pump section P can be easily separated from and connected to the refrigerator R, as necessary, without breaking a vacuum state of the side to be exhausted when being separated. As a result, a structure, which exerts no influences on the refrigerator R side during a high temperature baking treatment in order to clean the side including pump section P to be exhausted, is realized. The point to be noted with regard to the joint structure of the pump section P and the refrigerator R is that contacting heat resistance between both heat transfer means to be interconnected should be sufficiently reduced. More specifically, it is necessary to maintain a contacting area and a surface pressure of the joint section between a heat transfer means (i.e., the disk 10 and the heat transfer member 14) on the pump section P side and another heat transfer means (i.e., the cold receiving member 70) on the refrigerator R side, above a determined level. With regard to this structure, a tightening structure using a bolt is adopted in the first and second embodiments, however, in the third embodiment a fitting structure employing concave and convex sections is taken.

As shown in FIG. 7, a heat transfer member 76 of the refrigerator R side is supported through a spring member 77 on the cooling stage (the shield 50 and the cooler 69). The heat transfer member 76 is energized by the spring member 77 in a direction of the pump section P side. On the other hand, the heat transfer member 76 is connected to the cooling stage by flexible heat transfer members 78 in a heat transferable manner, and is cooled by the cooling stage through the flexible heat transfer member 78. A circular hole 79 with a bottom as a concave section is formed on the surface, facing the pump section P side, of the heat transfer member 76 on the refrigerator side. The hole 79 is of a tapering portion in section and tapers in a direction of its bottom, the circumference surface of which being served as a guide section 79*a*.

In order to bring the heat transfer member 76 in contact with a heat transfer member 80 on the pump section P side, a convex section 81 which can be fitted into the hole 79 is formed on the surface, facing the refrigerator R side, of the heat transfer member 80. The convex section 81 is of a tapering portion in section, tapering in a direction of its forward end, and the side surface of the convex section 81 is guided by the guide section 79*a* of the hole 79 so that the convex section 81 is fitted into the hole 79.

According to the embodiment, with the pump section P connected to the refrigerator R, the convex section 81 of the heat transfer member 80 on the pump section P side is automatically fitted into the hole 79 of the heat transfer member 76 on the refrigerator R side, at which time a gap is defined between the leading end surface of the convex section 81 and the bottom of the hole 79 (in addition, a gap may be defined between the side surface of the convex section 81 and the guide section 79*a* of the hole 79), and a surface 80*a* of the heat transfer member 80 excluding the surface of the convex section 81 and a surface 76*a* of the heat transfer member 76 excluding the surface of the hole 79 are closely contacted with each other to form a contacting surface. Thus, both heat transfer members 76 and 80 contact each other in a heat transferable manner through the contacting surfaces 76*a* and 80*a* having a given contacting area.

The heat transfer member 76 of the refrigerator side is energized by the spring member 77 toward the pump section P side. By this energizing force, the surface pressure at the contacting section of the heat transfer members 76 and 80 is secured.

Alternatively, as shown in FIG. 8, it is also possible to bring the forward end surface of the convex section 81 of the heat transfer member 80 in close contact with the bottom surface of the hole 79 of the heat transfer member 76 on the refrigerator R side to form a contacting surface. Instead of using the spring member 77, an energizing member of a shape memory alloy can be utilized so that when the cryopump is running at an extreme low temperature level, the energizing member of a shape memory allow changes its shape to generate a fixed surface pressure in the contact section between the heat transfer members 76 and 80.

In each of the embodiments of the invention described above, the refrigerator provided with the precooling refrigeration circuit 41 and the J-T circuit 61 is used. Besides this, it is possible to use a refrigerator having only the precooling refrigeration circuit 41 with a two stage structure, wherein, like the above embodiments, the connections of the first heat station 48 to the first cryopanel 2 and the second heat station 49 to the second cryopanel 5 are made in a heat transferable manner. In this case, the second cryopanel 5 should be cooled to an extremely low temperature level (i.e., below 20 K in the first embodiment, and below 15 K or thereabouts in the second embodiment).

The invention may be applicable not only to a cryopump for obtaining an extremely high vacuum below $10^{-10}$ Pa, but also to the one for obtaining a high or ultra high vacuum above $10^{-10}$ Pa.

We claim:

1. A cryopump comprising;

a vacuum vessel;

a pump section including a cryopanel positioned in a casing, said pump section being in communication with said vacuum vessel;

a refrigeration means having a cooling stage for cooling said cryopanel; and separation means for separably connecting said pump section and said refrigerator; said separation means including at least one heat transfer means between said refrigerator and said cryopanel of said pump section, said heat transfer means being separable at a position outside said casing;

wherein said casing of the pump section is insulated from said cryopanel of the pump section.

2. A cryopump according to claim 1, wherein the cryopanel of the pump section is connected to the casing by a tubular sealing member of a low heat conductivity material, and the heat transfer means is disposed in the sealing member with a gap between them.

3. A cryopump according to claim 1, wherein at least a part of the heat transfer means comprises a flexible member.

4. A cryopump according to claim 3, wherein the flexible member is stretchable such that the heat transfer means can be detached when separating the pump section from the refrigerator.

5. A cryopump according to claim 1, wherein a drive unit of the refrigerator and the casing of the pump section are connected together by bellows.

6. A cryopump according to claim 1, wherein the pump section includes at least a first cryopanel and a second cryopanel which is disposed in the first cryopanel, and the refrigerator has at least two cooling stages so as to cool the first and second cryopanels in such a manner that the second cryopanel is cooled to a lower temperature than the first cryopanel.

7. A cryopump according to claim 6, wherein a heat transfer means for establishing heat transfer between the first cryopanel of the pump section and the cooling stage of the refrigerator is disposed so as to cover and radially shield another heat transfer means for establishing heat transfer between the second cryopanel of the pump section and the other cooling stage of the refrigerator in a region between the pump section and the refrigerator.

8. A cryopump according to claim 6, wherein the pump section including the first and second cryopanels is made of completely an inorganic material such as metal.

9. A cryopump according to claim 8, wherein a mesh member of a high heat conductivity material is integrally joined to the inner surface of the second cryopanel.

10. A cryopump according to claim 8, wherein an inner surface of the second cryopanel is in a mesh form.

11. A cryopump according to claim 1, wherein the heat transfer means comprises a heat transfer member on the pump section side and another heat transfer member on the refrigerator side, the two heat transfer members being detachably connected together by means of a bolt.

12. A cryopump according to claim 1, wherein the heat transfer means comprises a heat transfer member on the pump section side and another heat transfer member on the refrigerator side, the two heat transfer members being detachably connected together by a concave section and a convex section which is fitted into the concave section in a heat transferable manner.

* * * * *

UNITED STATES PATENT AND TRADEMARK OFFICE

CERTIFICATE OF CORRECTION

PATENT NO. : 5,231,840

DATED : August 3, 1993

INVENTOR(S) : Nobuaki YAGI et al.

It is certified that error appears in the above-identified patent and that said Letters Patent is hereby corrected as shown below:

On the title page, after [22] Filed: Mar. 27, 1992, the following should be inserted:

-- [30] Foreign Application Priority Data

March 28, 1991 [JP] 3-064862
Feb. 27, 1992 [JP] 4-041092

Signed and Sealed this

Twenty-third Day of August, 1994

Bruce Lehman

*Attest:*

BRUCE LEHMAN

*Attesting Officer*

*Commissioner of Patents and Trademarks*